US008157585B2

(12) United States Patent
Zhu

(10) Patent No.: US 8,157,585 B2
(45) Date of Patent: Apr. 17, 2012

(54) ELECTRICAL DEVICE

(75) Inventor: Ren-huang Zhu, Xiamen (CN)

(73) Assignee: AU Optronics (Xiamen) Corp., Xiamen (CN)

( * ) Notice: Subject to any disclaimer, the term of this patent is extended or adjusted under 35 U.S.C. 154(b) by 0 days.

(21) Appl. No.: 12/615,118

(22) Filed: Nov. 9, 2009

(65) Prior Publication Data

US 2010/0136826 A1 Jun. 3, 2010

(30) Foreign Application Priority Data

Dec. 1, 2008 (CN) ..... 2008 1 0203854

(51) Int. Cl.
*H01R 13/73* (2006.01)

(52) U.S. Cl. ..... 439/571

(58) Field of Classification Search ..... 439/79, 439/571, 569, 82

See application file for complete search history.

(56) References Cited

U.S. PATENT DOCUMENTS

| | | | | | |
|---|---|---|---|---|---|
| 3,745,510 | A * | 7/1973 | Mallon | 439/78 |
| 3,932,012 | A * | 1/1976 | Reimer et al. | 439/70 |
| 4,915,655 | A * | 4/1990 | Tanaka | 439/83 |
| 4,945,192 | A * | 7/1990 | Urushibata et al. | 439/882 |
| 5,035,641 | A * | 7/1991 | Van-Santbrink et al. | 439/567 |
| 5,169,322 | A * | 12/1992 | Frantz et al. | 439/83 |
| 5,197,891 | A * | 3/1993 | Tanigawa et al. | 439/83 |
| 5,316,488 | A * | 5/1994 | Gardner et al. | 439/79 |
| 5,702,271 | A * | 12/1997 | Steinman | 439/79 |
| 6,220,895 | B1 * | 4/2001 | Lin | 439/607.01 |
| 6,932,659 | B1 * | 8/2005 | Wong | 439/853 |
| 7,182,610 | B2 * | 2/2007 | Lin | 439/79 |
| 7,670,150 | B2 * | 3/2010 | Hisamatsu et al. | 439/79 |
| 2003/0171014 | A1 | 9/2003 | Lin | |
| 2004/0157491 | A1 | 8/2004 | Lin | |

FOREIGN PATENT DOCUMENTS

| | | | |
|---|---|---|---|
| CN | 2355461 | Y | 12/1999 |
| CN | 2358598 | Y | 1/2000 |
| CN | 2754236 | Y | 1/2006 |
| TW | 514346 | | 12/2002 |
| TW | 555209 | | 9/2003 |
| TW | M258460 | Y | 3/2005 |
| TW | 200836412 | | 9/2008 |

* cited by examiner

*Primary Examiner* — Briggitte R Hammond

(57) ABSTRACT

An electrical device includes a connector, a circuit board and a connector-securing structure. The connector includes a body and a fixing pin extending from the body for fixing the connector on the circuit board. The circuit board defines a gap corresponding to an outer profile of the connector for receiving the connector. The connector-securing structure is provided for securing the connector in the gap of the circuit board. The connector-securing structure includes a holding portion and a holding slot. The holding portion is perpendicular to and extends from the fixing pin. The holding slot is defined through the circuit board in a position corresponding to the holding portion. The holding slot is engaged with the gap of the circuit board for receiving and holding the holding portion.

13 Claims, 5 Drawing Sheets

ELECTRICAL DEVICE

BACKGROUND OF THE INVENTION

1. Claim of Priority

This application claims priority to Chinese Patent Application No. 200810203854.4 filed on Dec. 1, 2008.

2. Field of the Invention

The present invention generally relates to an electrical device and a connector-securing structure, and more particularly, relates to an electrical device and a connector-securing structure using a through-board method for securing a connector in a gap of a circuit board.

3. Description of Prior Art

An electrical connector is an important element in an electrical device. The connector is usually secured to a circuit board in an electrical device by a soldering process to electrically connect to other connectors for transmitting signals. The connector may be secured to the circuit board in two methods: using a through-board method or using an on-board method. Using the through-board, the connector is set in a gap of the circuit board and soldering fixing terminals of the connector on a surface of the circuit board.

During detecting, testing and maintaining process, operations of connecting and disconnecting the connector are repeatedly implemented. Connecting and disconnecting forces are mainly applied on soldering point between the fixing terminals of the connector and the circuit board. Due to the large volume of force that is applied during the repeatedly connecting and disconnecting processes, the connector sometimes becomes loosened or separated from the circuit board, resulting in an unreliable transmitting signal and even a short service life.

Providing securing posts on the connector and recesses in the circuit board corresponding to the securing posts is commonly used in the existing solution. The connector is secured to the circuit board by fitting the securing posts in the recesses of the circuit board. During detecting and maintaining process, connecting and disconnecting forces are mainly applied on the securing posts of the connector and the recesses of the circuit board when the operations of connecting and disconnecting the connector are implemented, thereby reducing the force being applied on the soldering point between the connector and the circuit board. However, when the connector is connected or disconnected by a larger force, the roots of the securing posts tend to easily crack and even break, thereby damaging the connector.

To solve the problem of easily damaging of the connector, U.S. patent application publication No. 2007/0093110 discloses a connector with a securing portion. The connector's securing portion comprises a soldering portion soldered on a circuit board. The connector's securing portion also comprises a tail portion which is inserted into a through-hole of the circuit board, thereby strengthening the fixing function of the securing portion and reducing the possibility of looseness of the soldering point, thus solving the problem of easily damaging of the connector. However, the circuit board is usually a multi-layer circuit board and includes many different layers such as a grounding layer, a signal layer etc. In some area of the circuit board, the soldering point formed between the through-hole and the tail portion tends to electrically connect the grounding layer and the signal layer and results in a short circuit. As a result, the connector can only be applied to a limited area of the circuit board. In order to prevent the short circuit problem, the through-hole must be specially processed to prevent short circuit so that the connector is applicable to all scopes of the circuit board. However, the short-circuit prevention process increases the manufacturing costs.

Therefore, it is necessary to propose a new electrical device and connector-securing structure to overcome the shortcomings of the existing securing structure.

SUMMARY OF THE INVENTION

The object of the present invention is to provide an electrical device and a connector-securing structure, which is capable of securely fixing a connector and has a long life time and a low manufacturing cost.

An electrical device in accordance with the present invention includes a connector, a circuit board and a connector-securing structure. The connector comprises a body and a fixing pin extending from the body. The circuit board defines a gap corresponding to an outer profile of the connector for receiving the connector. The circuit board is fixed with the connector by the fixing pin. The connector-securing structure is provided for securing the connector in the gap of the circuit board. The connector-securing structure includes a holding portion and a holding slot. The holding portion is perpendicularly bent from the fixing pin. The holding slot is defined through the circuit board in a position corresponding to the holding portion. The holding slot is communicated with the gap of the circuit board for receiving and holding the holding portion.

Because the holding slot of the connector-securing structure of the present invention is communicated with the gap of the circuit board, the holding portion is near the body of the connector and the holding slot and the fixing pin are located far apart. As a result, melted soldering under the fixing pin cannot flow to the holding slot, thereby avoiding the problem of short-circuit. Furthermore, the connector is secured to the circuit board by fitting the holding portion in the holding slot. When the connector is connected or disconnected, connecting or disconnecting force is mainly applied on the holding portion and the holding slot, thereby achieving a good securing effect, a long life time and a low manufacturing cost.

The present invention may best be understood through the following description with reference to the accompanying drawings, in which:

DETAILED DESCRIPTION OF THE INVENTION

Figure 1:
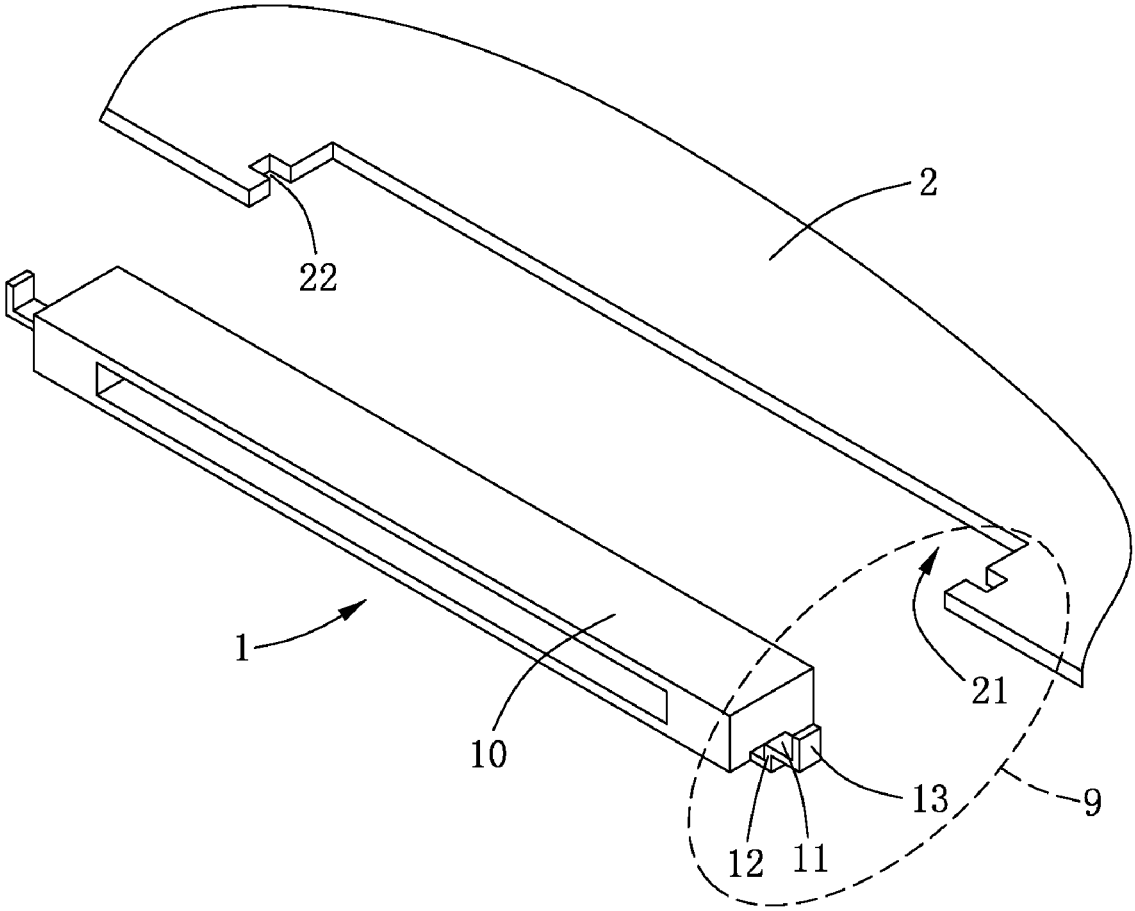
FIG. 1 is an exploded view of a connector-securing structure according to a preferred embodiment of the present invention.
Figure 2:
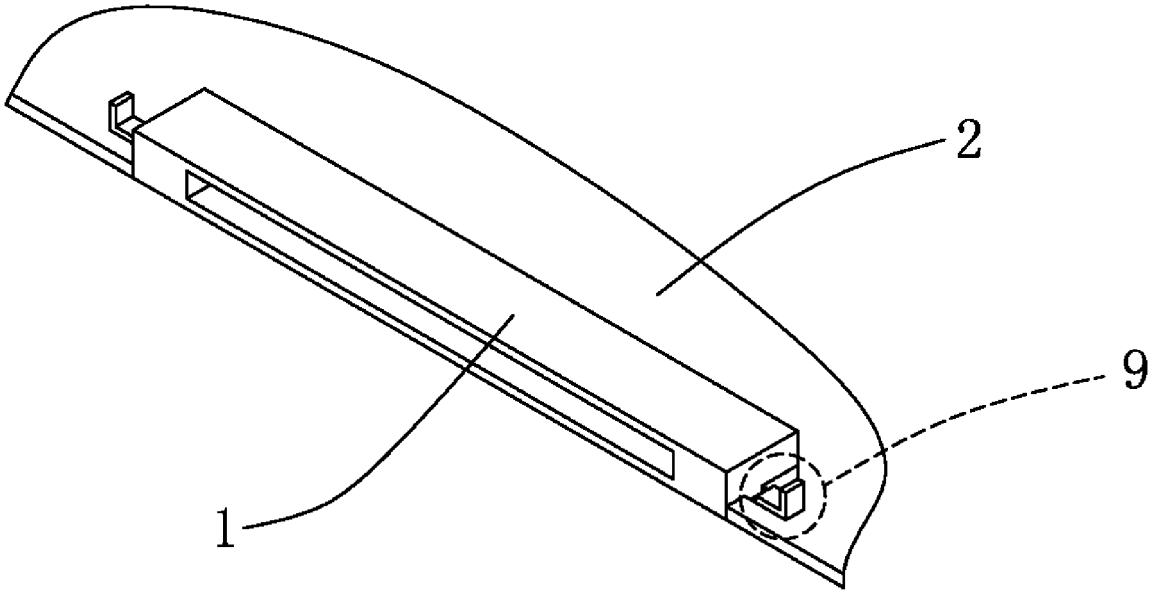
FIG. 2 is an assembly view of the connector-securing structure shown in FIG. 1.
Figure 3:
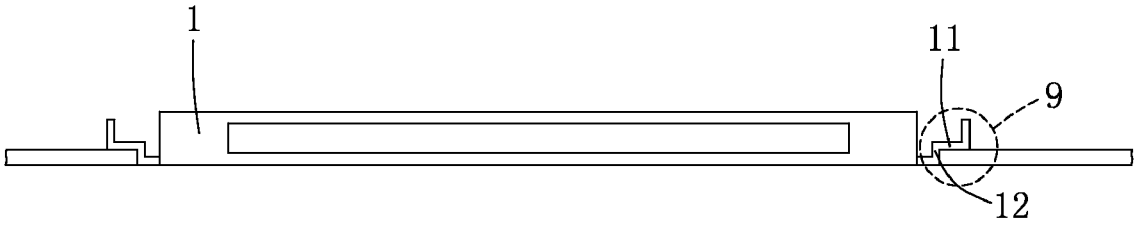
FIG. 3 is a side view of the connector-securing structure shown in FIG. 1, wherein the connector-securing structure is assembled.

Referring to FIGS. 1 to 3, FIG. 1 is an exploded view of a connector-securing structure according to a preferred embodiment of the present invention; FIG. 2 is an assembly view of the connector-securing structure shown in FIG. 1; FIG. 3 is a side view of the connector-securing structure shown in FIG. 1, wherein the connector-securing structure is assembled. A connector-securing structure 9 of the present invention is employed to secure a connector 1 in a gap of a circuit board 2. The connector 1 may be any type of connector, as long as the connector is fixed onto the circuit board 2 in a through-board method and also includes a body 10 and a fixing pin 11. The fixing pin 11 is extended from the body 10 for securing the connector 1 to the circuit board 2. The circuit board 2 defines a gap 21 corresponding to an outer profile of the connector 1 for receiving the connector 1 and is fixed with the connector 1 by the fixing pin 11. In the preferred embodiment of the present invention, the connector 1 is fixed on the circuit board 2 by soldering.

The connector-securing structure 9 is provided for securing the connector 1 in the gap 21 of the circuit board 2 and includes a holding portion 12 and a holding slot 22. The holding portion 12 is substantially perpendicularly to the fixing pin 11 and is located between the body 10 and the fixing pin 11. As shown in FIGS. 1 to 3, the holding portion 12 is extended to the holding slot 22 and is bent at right angles. The holding slot 22 is defined through the circuit board 2 in a position corresponding to the holding portion 12. The holding slot 22 is engaged with the gap 21 of the circuit board 2 for receiving and holding the holding portion 12, also noted that the height of the holding portion 12 is substantially less than or equal to the thickness of the holding slot 22. In other words, the height of the holding portion 12 is substantially less than or equal to the thickness of the circuit board 2. Because the holding slot 22 is engaged with the gap 21 of the circuit board 2, the holding portion 12 is near the body 10 of the connector 1 and the holding slot 22 and the fixing pin 11 are located apart. As a result, melted soldering under the fixing pin 11 cannot flow into the holding slot 22, thereby avoiding the problem of short-circuit.

Figure 4:
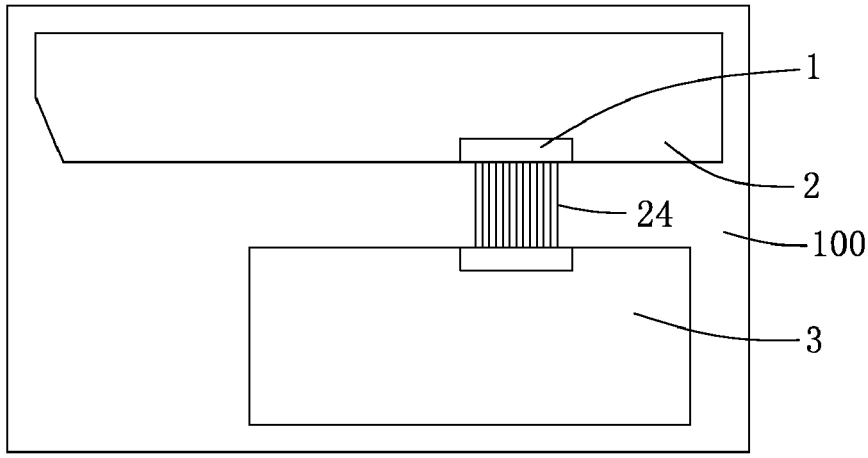
FIG. 4 is a diagram of an electrical device of the present invention.

Referring to FIG. 4, FIG. 4 is a diagram of an electrical device of the present invention. In the embodiment, the electrical device 100 of the present invention includes a liquid crystal display. The connector-securing structure 9 is located in the liquid crystal display. The electrical device 100 comprises a connector 1, a circuit board 2, a circuit board 3 and the connector-securing structure 9 (not shown). The connector 1 is secured to the circuit board 2 by a through-board method. The circuit board 2 is a data circuit board and the circuit board 3 is a control circuit board. The connector 1 and a cable 24 are electrically connected to the circuit board 2 with the circuit board 3 to establish signal transmission between the circuit board 2 and 3. In the above-mentioned embodiment, the connector-securing structure 9 being applied to the electrical device 100 with the liquid crystal display is illustrated as just one implementation example of the present invention. It can be understood that the connector-securing structure 9 can be applied to any type of electronic devices.

Figure 5:
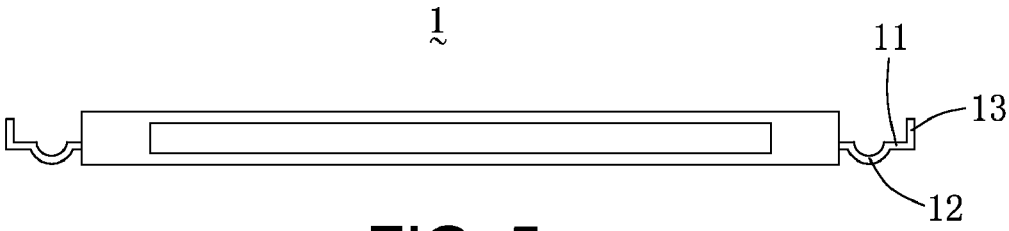
FIG. 5 is a side view of a connector according to another embodiment of the present invention.

In other embodiments, the holding portion 12 may be in different shapes. For example, the holding portion 12 is bent in a shape of a wave-form as shown FIG. 5. FIG. 5 is a side view of a connector according to another embodiment of the present invention. The holding portion 12 may be in a shape of a combination of a right angle and a wave. The holding portion 12 may be in any shape matched with the holding slot 22 of the circuit board.

Figure 6:
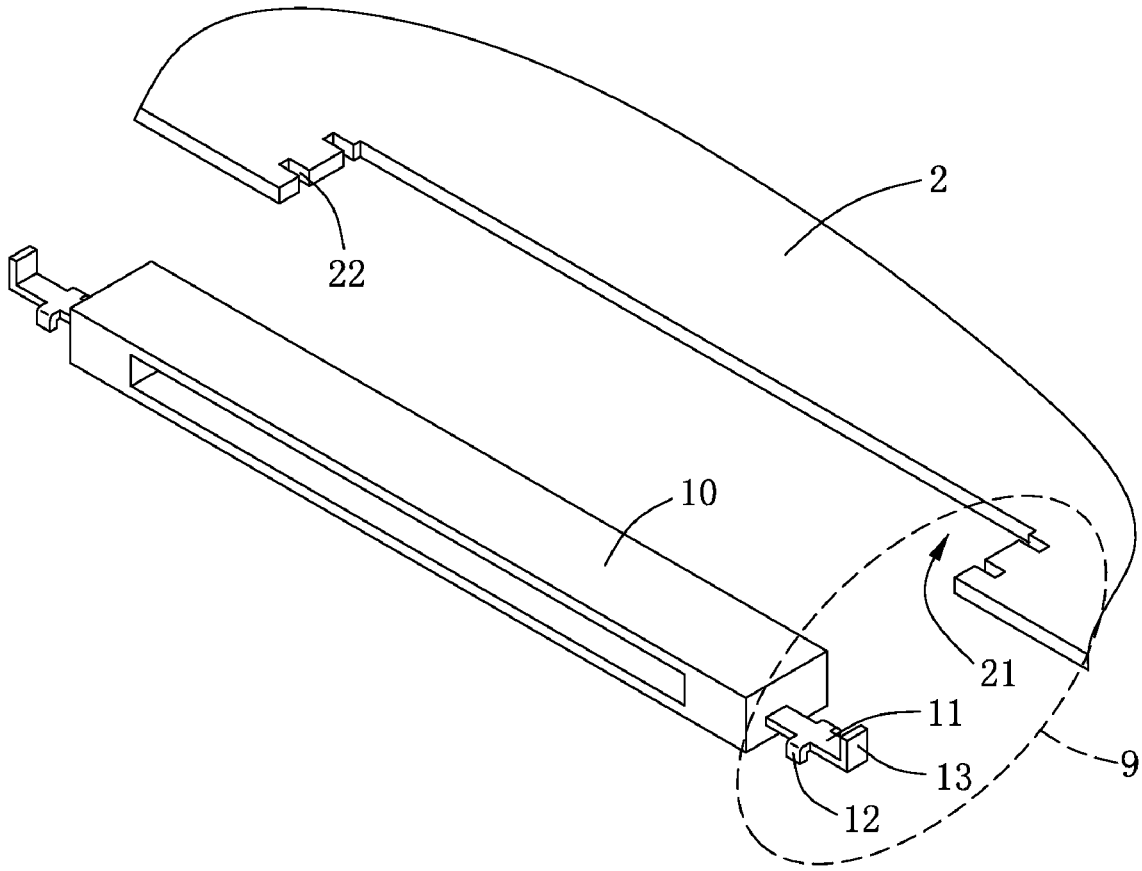
FIG. 6 is an exploded view of the connector-securing structure according to another embodiment of the present invention.

Referring to FIG. 6, FIG. 6 is an exploded view of the connector-securing structure according to another embodiment of the present invention. The fixing pin 11 comprises two sides. In another embodiment of the present invention, the holding portion 12 is bent perpendicularly from at least one side of the fixing pin 11 to the circuit board 2. The circuit board 2 defines the holding slot 22 in a position corresponding to the holding portion 12. The holding portion 12 and the holding slot 22 may be set in pairs. The holding slot 22 is engaged with the gap 21 of the circuit board 2 for receiving and holding the holding portion 12.

In the embodiments shown in FIGS. 1 to 6, the fixing pin 11 comprises a solder-wicking portion 13. The solder-wicking portion 13 extends from an one end of the fixing pin 11 in a direction that is away from the circuit board 2.

Figure 7:
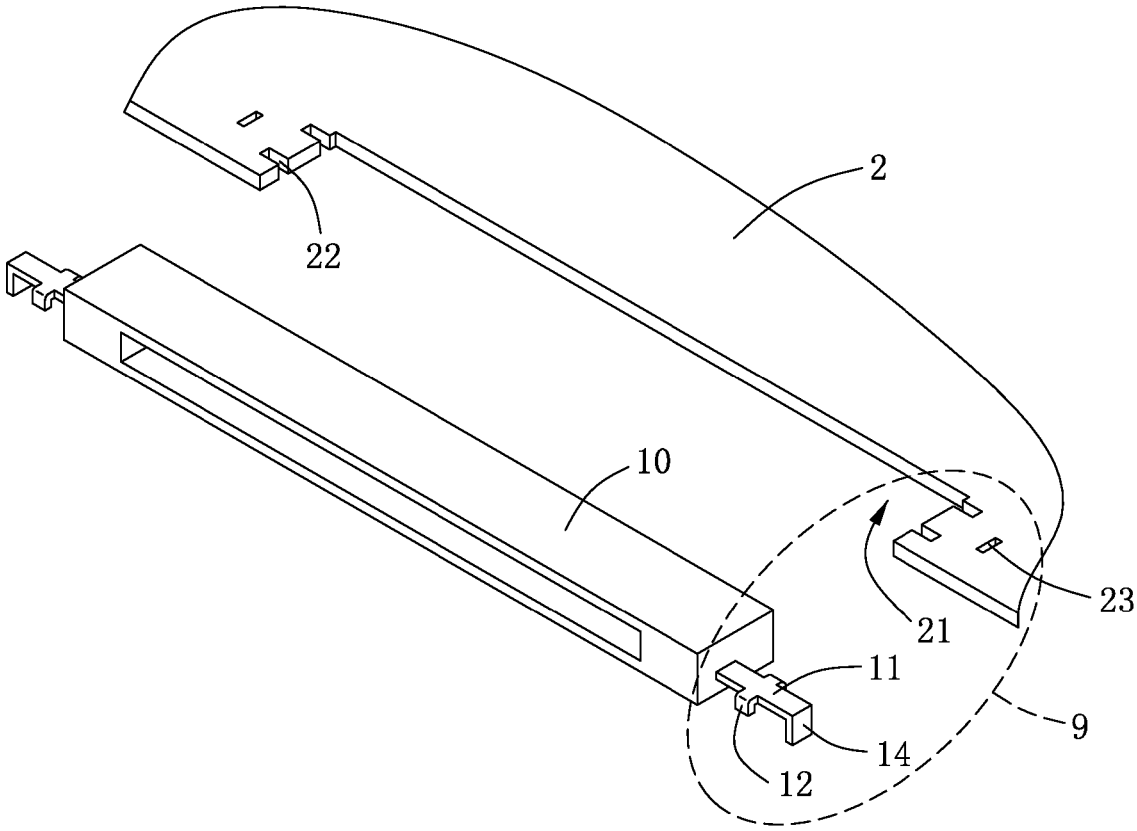
FIG. 7 is a side view of the connector-securing structure according to another embodiment of the present invention.

Referring to FIG. 7, FIG. 7 is a side view of the connector-securing structure according to another embodiment of the present invention. The fixing pin 11 comprises an auxiliary holding portion 14 for strengthening the effect of securing. The auxiliary holding portion 14 extends from one end of the fixing pin 11 in a direction that is toward the circuit board 2. The circuit board 2 defines an auxiliary holding slot 23 for receiving the auxiliary holding portion 14, correspondingly. In accordance with actual needs, it can be chosen to form the solder-wicking portion 13 or the auxiliary holding portion 14 on the fixing pin 11 to achieve different effects.

Because the holding slot of the connector-securing structure of the present invention is engaged with the gap of the circuit board, the holding portion is near the body of the connector and the holding slot and the fixing pin are located apart. As a result, melted soldering under the fixing pin cannot flow to the holding slot, thereby avoiding the problem of short-circuit. Furthermore, the connector is secured onto the circuit board by fitting the holding portion in the holding slot. When the connector is connected or disconnected, connecting or disconnecting force is mainly applied on the holding portion and the holding slot, thereby achieving a good securing effect, a long life time and low manufacturing costs.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical device comprising:

a circuit board defining a gap;

a connector comprising a body and a fixing pin extending from the body for soldering to the circuit board; and a connector-securing structure adapted for securing the connector in the gap of the circuit board, the connector-securing structure comprising:

a holding portion perpendicularly bent from the fixing pin; and a holding slot defined through the circuit board in a position corresponding to the holding portion, the holding slot engaged with the gap of the circuit board for receiving the holding portion, wherein the holding portion is located between the body and the fixing pin.

2. The electrical device of claim 1, wherein the holding portion is in a shape of a right angle, a wave or a combination of the right angle and the wave.

3. The electrical device of claim 1, wherein the fixing pin comprises two sides, the holding portion is perpendicularly bent from at least one side of the fixing pin.

4. The electrical device of claim 1, wherein the fixing pin comprises an auxiliary holding portion extending from the fixing pin in a direction of towards the circuit board, the circuit board defines an auxiliary holding slot for receiving the auxiliary holding portion, correspondingly.

5. The electrical device of claim 1, wherein the fixing pin comprises a solder-wicking portion, the solder-wicking portion extends from the fixing pin in a direction away from the circuit board.

6. The electrical device of claim 1, wherein the height of the holding portion is less than or equal to the thickness of the holding slot.

7. An electrical device comprising:

a connector, including a body and a fixing pin extending from the body;

a circuit board, defining a gap corresponding to outer profile of the connector for receiving the connector, the circuit board being fixed with the connector by the fixing pin; and a connector-securing structure comprising:

a holding portion perpendicularly bent from the fixing pin; and a holding slot defined through the circuit board in a position corresponding to the holding portion, the holding slot communicated with the gap of the circuit board for receiving the holding portion, wherein the holding portion is located between the body and the fixing pin.

8. The electrical device of claim 7, wherein the holding portion is shaped as a right angle, a wave or a combination of a right angle and a wave.

9. The electrical device of claim 7, wherein the fixing pin comprises two sides, the holding portion is perpendicularly bent from at least one side of the fixing pin.

10. The electrical device of claim 7, wherein the fixing pin comprises an auxiliary holding portion extending from the fixing pin in a direction towards the circuit board, the circuit board defines an auxiliary holding slot for receiving the auxiliary holding portion, correspondingly.

11. The electrical device of claim 7, wherein the fixing pin comprises a solder-wicking portion, the solder-wicking portion extends from the fixing pin in a direction away from the circuit board.

12. The electrical device of claim 7, wherein the height of the holding portion is less than or equal to the thickness of the holding slot.

13. The electrical device of claim 7, wherein the electrical device comprises a liquid crystal display.

* * * * *